US006933858B2

(12) United States Patent
Pieralli

(10) Patent No.: US 6,933,858 B2
(45) Date of Patent: Aug. 23, 2005

(54) SYSTEM AND METHOD FOR DETECTING OBSTACLES WITHIN THE AREA OF A RAILROAD GRADE CROSSING USING A PHASE MODULATED MICROWAVE SIGNAL

(75) Inventor: Moreno Pieralli, San Giovanni Valdarno (IT)

(73) Assignee: General Electric Company, Schenectady, NY (US)

( * ) Notice: Subject to any disclaimer, the term of this patent is extended or adjusted under 35 U.S.C. 154(b) by 77 days.

(21) Appl. No.: 10/647,413

(22) Filed: Aug. 25, 2003

(65) Prior Publication Data

US 2004/0104822 A1 Jun. 3, 2004

Related U.S. Application Data

(60) Provisional application No. 60/405,490, filed on Aug. 23, 2002.

(51) Int. Cl.[7] ..... G08G 1/16

(52) U.S. Cl. ..... 340/903; 340/435; 246/292

(58) Field of Search ..... 340/901–905, 340/928, 933, 435, 436, 541, 550, 552, 554, 561, 565; 246/125, 122 R, 126, 292–295, 473.1

(56) References Cited

U.S. PATENT DOCUMENTS

| | | | | |
|---|---|---|---|---|
| 2,085,798 A | * | 7/1937 | Gerhard | 342/126 |
| 4,901,575 A | | 2/1990 | Bohannan et al. | 73/587 |
| 4,956,999 A | | 9/1990 | Bohannan et al. | 73/587 |
| 5,233,353 A | * | 8/1993 | Guena et al. | 342/125 |
| 5,625,340 A | | 4/1997 | Gustavsson | 340/561 |
| 5,680,136 A | | 10/1997 | Chekroun | 342/6 |
| 5,774,045 A | | 6/1998 | Helma et al. | 340/436 |
| 5,890,682 A | * | 4/1999 | Welk | 246/125 |
| 6,129,025 A | | 10/2000 | Minakami et al. | 104/88.01 |
| 6,267,332 B1 | | 7/2001 | Almblad | 246/294 |
| 6,340,139 B1 | | 1/2002 | Hilleary | 246/292 |
| 6,492,933 B1 | * | 12/2002 | McEwan | 342/28 |

FOREIGN PATENT DOCUMENTS

| | | |
|---|---|---|
| EP | 0 371 631 A2 | 6/1990 |
| WO | WO 93/15416 A1 | 8/1993 |
| WO | WO 97/07005 A1 | 2/1997 |
| WO | WO 01/37060 A1 | 5/2001 |

* cited by examiner

*Primary Examiner*—Brent A. Swarthout
(74) *Attorney, Agent, or Firm*—Carl A. Rowold, Esq.; Enrique J. Mora, Esq.; Beusse, Brownlee, Wolter, Mora & Maire, P.A.

(57) ABSTRACT

A system and method for automatically detecting the presence of an obstacle located within a surveillance area associated with a railroad grade crossing. The system includes a transmitter transmitting a signal through the surveillance area and a modulating reflector receiving the transmitted signal. The modulating reflector includes a phase modulator receiving the received signal and generating a phase modulated signal having a characteristic. The modulating reflector transmits the phase modulated signal through the surveillance area that is received by a receiver located to receive the phase modulated signal. The system further includes a processor coupled to the transmitter and to the receiver, the processor being configured to process the received phase modulated signal and to initiate an action as a function of the characteristic in the received phase modulated signal.

28 Claims, 9 Drawing Sheets

SYSTEM AND METHOD FOR DETECTING OBSTACLES WITHIN THE AREA OF A RAILROAD GRADE CROSSING USING A PHASE MODULATED MICROWAVE SIGNAL

CROSS REFERENCE TO RELATED APPLICATIONS

This is a non-provisional patent application that claims priority to U.S. Provisional Patent Application No. 60/405,490, filed Aug. 23, 2002.

FIELD OF THE INVENTION

The invention relates generally to railroad grade crossing systems. More particularly, the invention relates to a system and method for automatically detecting the presence of an obstacle within the area of a railroad track grade crossing using phase modulated microwave signals.

BACKGROUND OF THE INVENTION

FIG. 1 illustrates a typical prior art railroad grade crossing 100 with a single railroad track 102. A first gate 104A and 104B is closed when a train approaches on track 102 thereby restricting the flow of traffic from the corresponding side of track 102. A second gate 106A and 106B is closed on the opposite side of track 102 from gates 104A and 104B to restrict the flow of traffic from the opposite side.

In FIG. 2, a similar prior art railroad grade crossing 200 is shown but with two tracks 202 and 204 shown as the grade crossing 200. Similar to shown above for the single track configuration 100, a first gate 206A and 206B is closed when a train approaches on track 202 or 204 thereby restricting the flow of traffic from that side of track 102. A second gate 208A and 208B is closed on the opposite side of tracks 202 and 204 from gates 206A and 206B to restrict the flow of traffic from the opposite side.

In these prior art systems, the gates close when an approaching train is detected. In order to detect obstacles located between closed gates in the proximity of the tracks, some prior art systems rely on a transmitter/receiving system that is responsive to reflections of the transmitted signals by the obstacles themselves and do not utilize a reflector or detect the presence of a signal from the reflector. See U.S. Pat. No. 6,340,139 and U.S. Pat. No. 5,625,340.

Other prior art systems rely on reflectors that reflect frequency-modulated radar which utilize the frequency and amplitude differences between the transmitted and reflected signal to determine the presence of an object in the surveillance area. These prior art systems detect differences in signal amplitude and the signal phase. The later results from a phase shift determined by the signal transit time as defined by a transit time component at the reflector. However, in this later prior art embodiment, the receiving includes a receiver, circulator, transit time element, a directional separating filter, and an amplifier, each of which add to the complexity and cost of the system. See U.S. Pat. No. 5,775,045.

Several systems have been developed which utilize microwave detection systems. However, prior art systems currently encounter problems such as false detection of obstacles, inaccurate detection of obstacles, failure to detect obstacles, detection of echoes, inadequate area of surveillance, and high cost associated with the initial installation and with ongoing operations.

Existing systems do not accurately monitor the crossing area between the closed gates to detect the presence of obstacles such as road vehicles or persons who may be located between the closed railway gates. Therefore, there is a need for an improved obstacle detection system and method for automatically detecting the obstacles within the railroad grade crossing. There is a need for a detection system and method for railroad grade crossings that provides for an accurate detection of obstacles within an area of surveillance that adequately covers the areas between the first and second crossing gates and the railroad tracks therein enclosed.

There is also a need for a system that is less costly than currently available systems. Such a system and method monitors the railroad grade crossing and determines when an object is within the railroad grade crossing after the railroad crossing gates have been activated, by detecting only the well-defined demodulated signal, thereby excluding all possible echoes, interference signals, and noise.

SUMMARY OF THE INVENTION

In order to address the need for improved detection of obstacles in a railway crossing area, the inventors have invented a system for automatically detecting the presence of an obstacle located within a surveillance area associated with a railroad grade crossing. The system includes a transmitter transmitting a signal through the surveillance area and a modulating reflector that receives the transmitted signal. The modulating reflector includes a phase modulator that receives the received signal and generates a phase modulated signal having a characteristic. The modulating reflector transmits the phase modulated signal through the surveillance area where a receiver is located to receive the phase modulated signal. A processor is coupled to the transmitter and to the receiver and is configured to process the received phase modulated signal. The processor initiates an action as a function of the characteristic in the received phase modulated signal.

In another aspect, the invention is a method for automatically detecting the presence of an obstacle located within a surveillance area associated with a railroad grade crossing. The method includes transmitting a microwave signal through the surveillance area and receiving the microwave signal at a modulating reflector. The modulating reflector includes a phase modulator creating a phase modulated signal containing a characteristic. The modulating reflector transmits the phase modulated signal through the surveillance area where a receiver receives the phase modulated signal. The method also includes processing the received signal to determine characteristic within the received phase modulated signal. The method further includes initiating an action as a function of the determined characteristic in the received phase modulated signal.

Other aspects of the present invention will be in part apparent and in part pointed out hereinafter.

BRIEF DESCRIPTION OF THE DRAWINGS

Corresponding reference characters and designations generally indicate corresponding parts throughout the drawings.

DETAILED DESCRIPTION

Figure 1:
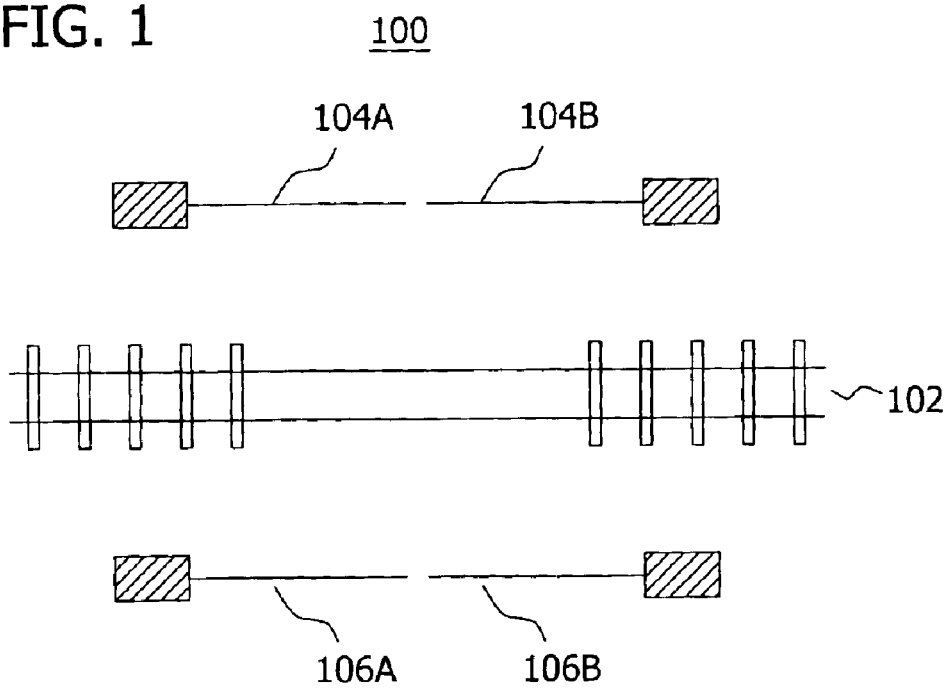
FIG. 1 is an illustration of a prior art railroad grade crossing for a single track crossing.
Figure 2:
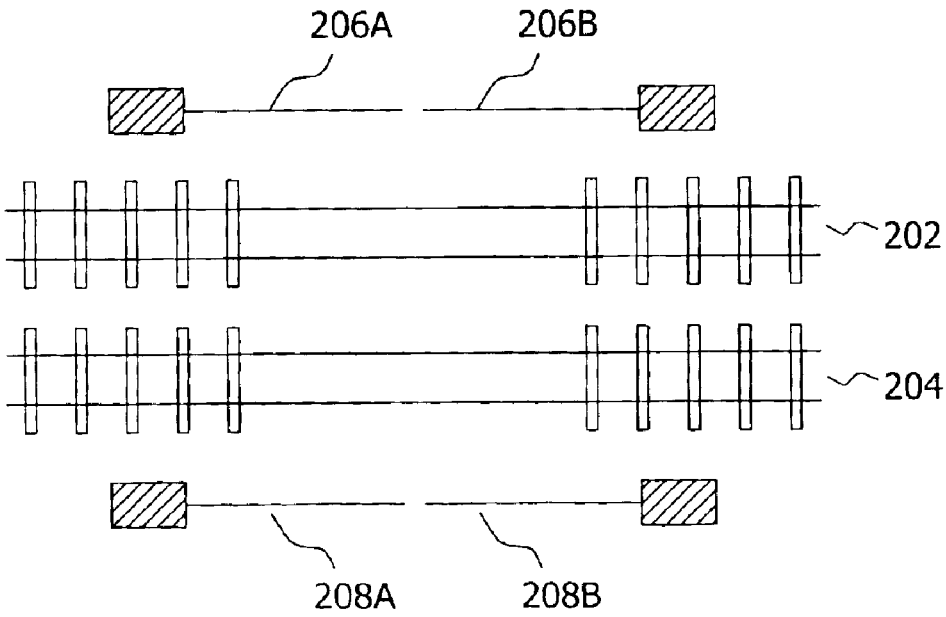
FIG. 2 is an illustration of a prior art railroad grade crossing for a two track crossing.
Figure 3:
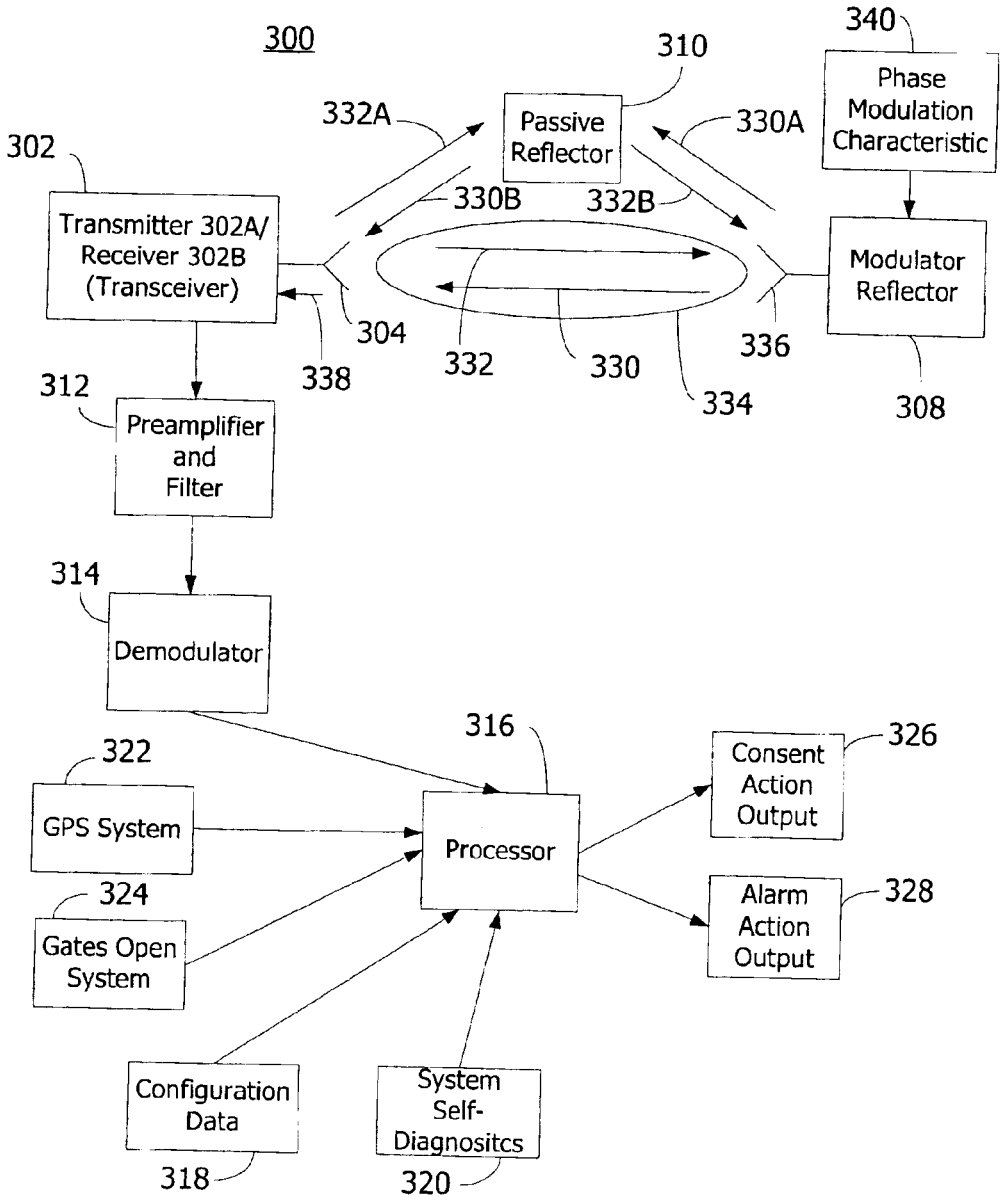
FIG. 3 is a schematic illustrating an exemplary railroad grade crossing detector system.

FIG. 3 is a simplified block diagram of one embodiment of a system 300 for automatically detecting the presence of an obstacle within the area of a railroad track grade crossing using a microwave transmitter/receiver 302 and a modulating reflector 308. Transmitter/receiver 302 is equipped with an antenna 304. As shown, transmitter/receiver 302 may be a combined transceiver 302, or may be a separate transmitter 302A and a separate receiver 302B. In such a latter case, transmitter 302A and receiver 302B may each be equipped with an antenna 304. Transceiver 302 provides received signal 338 to a preamplifier 312 that provides a processed signal to a demodulator 314. Demodulator 314 provides a demodulated received signal 338 to a processor 316 for signal analysis.

Processor 316 may be a single processor, or may in another embodiment be configured as a multiple processor 316. In one embodiment, processor 316 is a dual-processor 316 configuration. Processor 316 may be comprised of a memory (not shown), hardware, software and/or firmware. The functions described with regard to processor 316 may be configured and performed by one or more of software, firmware, or hardware.

Transmitted signal 332 is transmitted by transmitter 302A and received by one or more modulating reflectors (MDR) 308. Modulating reflector 308 receives transmitted signal 332 and introduces a characteristic to create modulated signal 330. Modulated signal 330 is transmitted or reflected by modulating reflector 308 and is received by receiver 302B. System 300 provides enhanced definition of surveillance area 334 as defined by transceiver 302 and a modulating reflector 308 and associated transmitted signal 332 and modulated signal 330. Transmitted signal 332 and modulated signal 330 define surveillance area 334 such that the detection of an obstruction in surveillance area 334 is a function of the disruption of either the transmitted signal 332 or modulated signal 330 as will be further discussed below.

In one embodiment, transceiver 302 operates in band X at a frequency of 9.2 GHz to 10.6 GHz, e.g., 10.0 GHz with a 22.0 MHz FM sweep/bandwidth. In one embodiment, this is a continuous-wave microwave signal. The power of transmitter 302A may be in the range of 10 mW, plus or minus 1 mW. Other power levels of transmitter 302A may be in the range of 20 mW, plus or minus 2 mW. Receiver 302B may be, in one embodiment, the originating site which is transceiver 302. In another embodiment, receiver 302B may be separate from transmitter 302A. In yet another embodiment, dual receivers 302B may be used wherein their received signals 338 are combined and the combined signal is analyzed. This later embodiment may be applicable where the frequency of transmitted signal 332 may result in a null signal such as results from phase shifts or other signal patterns that result in the transmitted signal 332 negatively affecting the modulated signal 330, thereby negatively affecting the ability to detect modulating signal 330 and any characteristic introduced by the modulating reflector 308.

In another embodiment, transceiver 302 transmits a frequency modulated transmitted signal 332 rather than a continuous or single frequency signal. In such an embodiment, frequency modulation with a bandwidth between 5.0 and 25.0 MHz may be introduced in transmitter 302A. By introducing frequency modulation into transmitted signal 332, the frequency of unwanted amplitude modulation is increased to a level that enables improved detection of a peak of received signal 338 and/or the sidebands in received signal 338.

In one embodiment, antenna 304 maybe a directional antenna that provides for the formation of transmitted signal 332 such as to define surveillance area 334. The selection of the type of transceiver antenna 304 is dependent on the shape of the desired surveillance area 334, the intended distance required for surveillance of surveillance area 334, and the frequency of transmitted signal 332. For instance, a parabolic antenna may provide a beam angle of 5 degrees whereas a horn antenna may provide a beam angle of 30 degrees. In addition, in one embodiment, transceiver antenna 304 may have a TX/RX Ø=35 cm.

Modulating reflector 308 is responsive to transmitted signal 332. Modulating reflector 308 may comprise or include a modulating reflector antenna 336. In one embodiment, modulating reflector 308 is a modulating horn reflector with a horn reflector size of 12.5×9.5×15 cm. In another embodiment, modulating reflector 308 is a pyramidal horn reflector resulting in a maximum distance between modulating reflector 308 and transceiver antenna 304 of 100 meters. In yet another embodiment, modulating reflector 308 is a parabolic reflector that provides for a maximum distance between modulating reflector 308 and transceiver antenna 304 of 200 meters.

In another embodiment as shown in FIG. 3, a passive reflector 310 is positioned to receive transmitted signal 332A from transmitter 302A, and passively reflect transmitted signal 332B to modulating reflector 308. Additionally, passive reflector 310 may be positioned to receive modulated signal 330A from modulating reflector 308 and to passively redirect modulated signal 330B to receiver 302B. By positioning passive reflector 310, surveillance area 334 may be shaped, expanded, or designed to particular railroad crossing applications and designs to more effectively monitor the desired surveillance area 334 for obstructions. Passive reflector 310 may also be used to form two segments of transmitted signal 332 that define two separate surveillance areas 334. For example, in one embodiment, passive reflector 310 defines a second surveillance area 334 that is at an angle of up to 60 degrees from the first surveillance area 334. In other embodiments, the angle between the two surveillance areas 334 created by passive reflector 310 may be greater than 60 degrees. In such embodiments, the reflected energy is reduced and thereby the area defined by the transmitted signal 332 and the modulated signal 330 is reduced. However, by using passive reflector 310 with an angle less than or equal to 60 degrees, the total surveillance area 334 covered by transmitted signal 332 and modulated signal 330 may be expanded to survey more complex areas and to provide more complete surveillance coverage.

The selection of the transceiver antenna 304 and modulating reflector antenna 336 defines the size of surveillance area 334 including a distance (or length) between transceiver 302 and modulating reflector 308. In one embodiment where transceiver antenna 304 is a horn antenna and modulating reflector antenna 336 is a horn, the distance between antennas 304 and 336 to define surveillance area 334 is between 10 and 28 meters. In another embodiment where transceiver antenna 304 is a horn antenna and modulating reflector antenna 336 is a parabola, the distance is between 18 and 28 meters. In yet another embodiment where transceiver antenna 304 is a parabola antenna and modulating reflector antenna 336 is a parabola, the distance is between 28 and 60 meters. Similarly, when passive reflector 310 is included in the system. In one embodiment where transceiver antenna 304 is a horn antenna and modulating reflector antenna 336 is a parabola, the distance is between 10 and 25 meters. In another embodiment where transceiver antenna 304 is a parabola antenna and modulating reflector antenna 336 is a parabola, the distance is between 25 and 50 meters.

In one embodiment, modulating reflector 308 receives transmitted signal 332. Modulating reflector 308 phase modulates the received transmitted signal 332 and re-transmits modulated signal 330 with a phase modulation characteristic 340 by reflection to receiver 302B. Modulating reflector 308 may be a passive device or may be an active device. In one embodiment, modulating reflector 308 produces modulated signal 330 by introducing characteristic 340 such as a phase modulation to received transmitted signal 332 with a phase modulation of between 0° and 180° at a frequency of around 10.0 KHz. In various embodiments, the phase modulation is at 4.0 KHz, 4.7 KHz, 5.7 KHz, 6.7 KHz, 9.0 KHz, or 12.0 KHz. Other frequencies for the phase modulation in the range of 4.0 KHz to 13.0 KHz may also be used. In yet another embodiment, modulating reflector 308 is a multiphase or continuous phase shift modulating reflector with eight (8) or more different phases. Such an embodiment may be beneficial in eliminating unwanted amplitude modulation of modulated signal 330.

The modulation by modulating reflector 308 results in one or more uniquely identifiable characteristics 340 in modulated signal 330 which provide for the detection of obstacles. For example, phase modulation may create sidebands in the modulation signal 330 that are not present in the transmitted signal 332, e.g., the transmitted carrier signal. The amplitude, energy, frequency, or number sidebands may define various embodiments the characteristic.

Receiver 302B is responsive to signals in the frequency range of transmitted signal 332 and modulated signal 330. Received signal 338 as received by receiver 302B may or may not contain characteristic 340 as introduced by modulating reflector 308. Received signal 338 is converted into base band using a portion of the carrier signal from transmitter 302A in transceiver 302. Preamplifier and filter 312 amplifies and filters received signal 338 and passes the conditioned received signal 338 to demodulator 314. Received signal 338 is demodulated by demodulator 314 to process received signal 338 for signal analysis by processor 316 for analysis of the amount of characteristic 340 as introduced by modulating reflector 308. This amount is indicative of an obstacle in surveillance area 334.

In the transceiver 302, transmitted signal 332 or the carrier components thereof is mixed with received signal 338 wherein the carrier signal is canceled thereby only leaving the sidebands for analysis by processor 316. The sidebands are analyzed for determination of the desired characteristic 340 and thereby the presence or absence of an object in surveillance area 334.

In one embodiment, the signal analysis process by processor 316 includes detecting and comparing the amount of energy in the sidebands of received signal 338, such as represented by the amplitude of the peak of the sideband. Received signal 338 is filtered by preamplifier filter 312 to remove echoes that may be due to Doppler effects from moving objects. After such filtering, received signal 338 only includes, in the absence of an object in surveillance area 334, characteristic 340 as introduced by modulating reflector 308. In one embodiment, the phase modulation frequency is selected at a frequency that is higher than Doppler-effect frequencies that result from an object moving in surveillance area 334. As noted above, frequencies of 4 KHz, 4.7 KHz, 5.7 KHz, or 6.7 KHz may be used when a carrier frequency of transmitted signal 332 of 10 GHz is used.

As noted, the desired characteristic 340 may be a specific amplitude, frequency, and/or phase of the sidebands contained in received signal 338. The received signal and its sidebands are analyzed and compared against predefined values, thresholds, or models. For example, if the received signal has a sideband with amplitude peak or energy level that exceeds a predefined value, processor 316 may determine that an obstacle is not present in surveillance area 334. However, if the amplitude peak of the sideband of the received signal is below the predefined value or threshold, then processor 316 would determine that an obstacle is within surveillance area 334. In one embodiment, it may be determined that a decrease of more than 3 dB in the peak amplitude of the first sideband indicates that an object is in surveillance area 334.

The amount of energy in the sidebands of the sidebands in received signal 338 may also be utilized to determine the presence or absence of an object. If the determined energy level is found to be below a predetermined level, processor 316 may determine that an object is present in surveillance area 334. In one embodiment, the system may detect and determine the amount of total energy in the first, second, and third sidebands of received signal 338. The total energy level of such sidebands is compared to a predetermined energy level. In one embodiment, when the total energy level is 80 percent of the normal level, e.g., a reduction of 20 percent, processor 316 determines that an obstacle is present in surveillance area 334. In other embodiments, the one or more sidebands may be analyzed and/or the deviation may range from 5 percent to 50 percent for the energy or peak amplitude of the sidebands.

In one embodiment, the predetermined comparison levels for peak amplitude or energy level detection are established during product development, product design, and/or product deployment based on testing and operation, and are dependent on the transmitted frequency. In some embodiments, system 300 includes a variable input function (not shown) that enables an operator to adjust the sensitivity or threshold levels of processor 316 used to determine whether received signal 338 contains the desired characteristic 340 and thereby determine whether or not an object is detected within surveillance area 334.

If received signal 338 contains the desired amount of characteristic 340 as introduced by modulating reflector 308 as described above, system 300 provides an indication that surveillance area 334 is free of obstacles. The presence of desired amount of characteristic 340 as generated by modulating reflector 308 indicates that received signal 338 is that which was originally transmitted as transmitted signal 332, modulated by modulating reflector 308, and re-transmitted as modulated signal 330 with characteristic 340. The receipt of the desired amount of characteristic 340 in modulated signal 330 also ensures that improper or false signals that are received do not provide a false indication that surveillance area 334 is clear.

In an alternative embodiment, system 300 may be comprised of two or more transceivers 302 each operating at a separate frequency. In this embodiment, it may be viewed as having two separate received signals 338 being received by receiver 302B, or that one received signal 338 is received, but the received signal 338 having more than one signal component. In one view two transmitted signals 332 are transmitted two transceivers 302, and two modulated signals 330 with two characteristics 340 are generated by modulating reflector 308. In either case, the signal conditioning, demodulation, and analysis process described above is applied with regard to each received signal 338. The determination by processor 316 with regard to the presence of an object in surveillance area 334 is determined by a combination of the signal analysis for each of received signals 338.

In another embodiment, transceiver 302 separately detects a plurality of modulated signals 330 and characteristics 340 from a plurality of modulating reflectors 308. In such an embodiment, each modulating reflector 308 is tuned to phase modulate transmitted signal 332 at a unique and separate phase modulated frequency. Each receiver 302B is tuned to demodulate the signal to determine the characteristics 340, thereby determining the presence of obstacles in each of the defined surveillance areas 334. In such an arrangement, each set of transmitters 302A, modulating reflectors 308, and receivers 302B, define separate surveillance areas 334 that may include multiple paths as defined by the areas between each set of communicating transmitters 302A, modulating reflectors 308, and receivers 302B. For example, see FIG. 9.

In another embodiment, a GPS system 322 receives data signals from a Global Positioning Satellite (GPS) system (not shown). In this embodiment, system 300 receives and stores in a memory (not shown) the time and/or synchronization signals from the received GPS data. Processor 316 may utilize received GPS data to enhance the reporting, administration, and/or diagnostics capabilities of system 300.

In operation, the surveillance operation of system 300 is initiated when a gates closing signal is received from the crossing gate system 324 indicating that the gates have closed. Upon receipt of the gate closing signal, system 300 begins to transmit transmitted signal 332 and to receive received signal 338 to monitor surveillance area 334 for obstacles in the crossing after the closing of the gates. In one embodiment, system 300 discontinues checking the crossing or surveillance area 334 after the activation of the track open signal. In another embodiment, system 300 continues to survey the surveillance area 334 if the surveillance area 334 is not interrupted by an expected obstruction such as a passing railway vehicle.

When no obstruction is detected, system 300 generates a consent action 326 that in one embodiment is an initiation of a relay that is energized by processor 316. When an obstacle is detected in the crossing area or surveillance area 334, an open area indication is not generated and further action is taken. In one such embodiment, an alarm action 328 is initiated by processor 316 such as the energizing of an alarm relay. In another embodiment, the event or action data is stored in a memory (not shown) so that the data events can be analyzed at a later time or by a remote administration system (not shown).

In another embodiment, processor 316 is configured to provide one or more operational functions. These include receiving information relative to the lowering or rising of the gates for the gates open system 324. Processor 316 may initiate the transmission of transmitted signal 332 by transmitter 302A when receiving information or a gates closing signal from gates open system 324 indicating that the gates have been lowered. When demodulator 314 has received the processed received signal 338, processor 316 analyzes the received signal for characteristic 340. When processor 316 determines from received signal 338 the desired amount of characteristic 340 as described above, processor 316 may generate consent signal 326. When processor 316 determines that received signal 338 does not contain the desired amount of characteristic 340 and therefore determines that an obstacle is present in surveillance area 334, processor 316 generates the occupied area alarm 328.

In other embodiments, as an option processor 316 acquires and verifies the integrity of the internal components of system 300. Processor 316 may also initiate and provide self-diagnosis and check on efficiencies of operations of all system components (see 320) including providing automatic self-test of transmitters 302A and receivers 302B. Processor 316 may also provide for administration and management of various inputs and outputs to system 300 such as communication ports/links (not shown) including the acquisition of the time reference signal from GPS system 322. Processor 316 also may manage an anti-intrusion sensor associated with system 300 equipment cabinets containing transmitter 302A, receiver 302B, modulating reflector 308, passive reflector 310, and other system equipment. Processor 316 may also provide a system failure alarm either as a local alarm or to a remote administrative entity or system (not shown). Processor 316, in conjunction with a memory (not shown), may record or store the actions or events as determined by processor 316 and generate the communication of such events, actions, and status to remote sites, systems, or entities.

Figure 4:
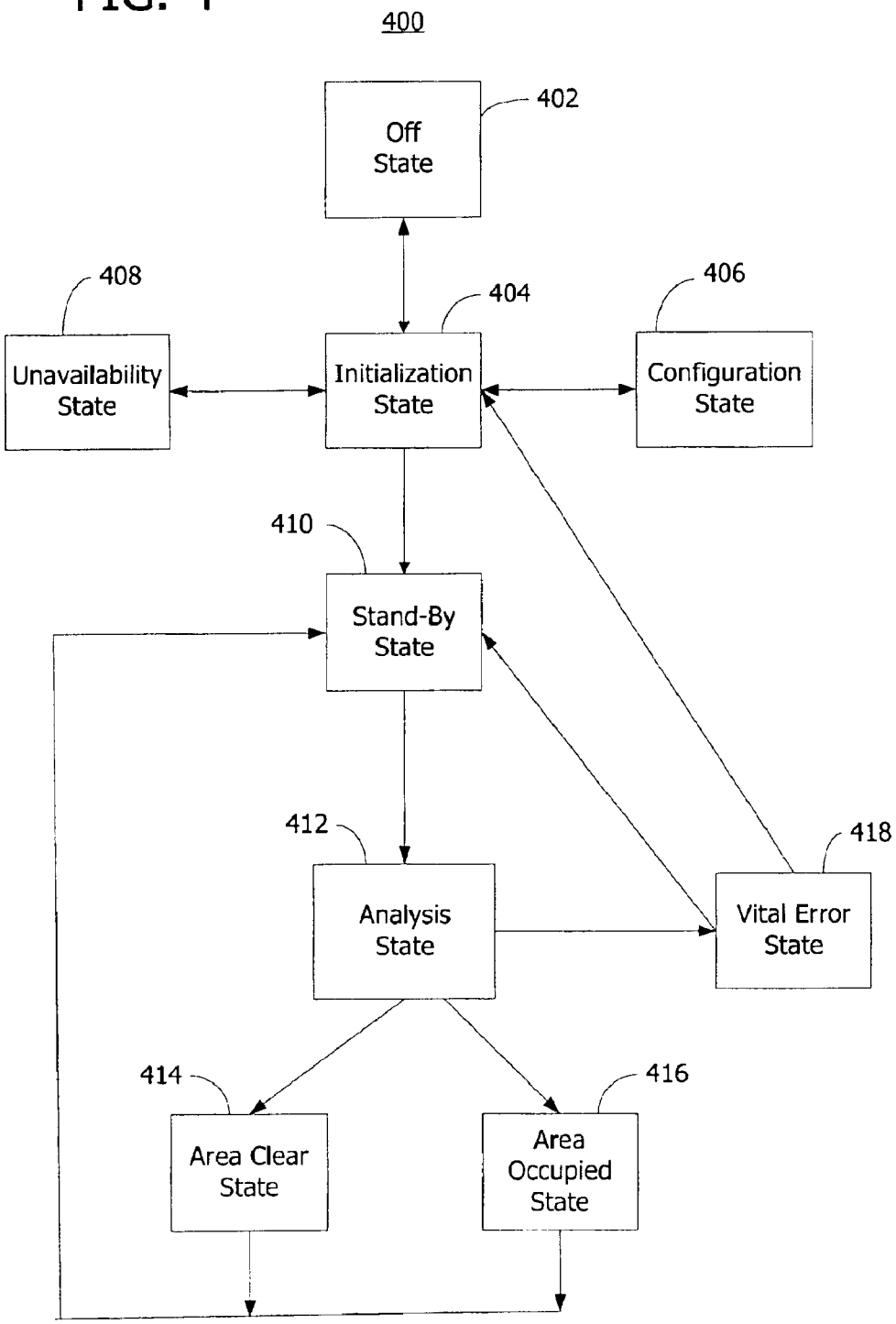
FIG. 4 is a control state diagram for an exemplary railroad grade crossing detector system.

In FIG. 4, operating states of one embodiment of the invention are illustrated. The first state is a system off state 402. When power is initially provided to system 300, processor 316 shifts to an initialization state 404. In this state, processor 316 verifies its configuration and operating status. If the configuration is not present, processor 316 shifts to a configuration state 406 to obtain configuration information or data from an external source. In one embodiment, this information could be obtained from a remote administration system via a communication link (not shown). If correct configuration data is present, processor 316 controls the presence of repetitive errors that occurred before the last reset of processor 316. If an error exists, then processor 316 shifts to unavailability state 408 and waits for an external command via a communication link to restart surveillance by system 300. If there is an error in the system, processor 316 may also shift to unavailability state 408, and an alarm or notification is made to an external system or administration system indicating the need for repair. In another embodiment, unavailability state 408 may automatically initiate a system restart (not shown).

If processor 316 passes the tests and configuration diagnostics of initialization state 404, processor 316 shifts to a stand-by state 410. In this state, the system is operational and is awaiting an external indication to enter an analysis state 412. During stand-by state 410, the system is operating correctly without any errors and is awaiting the "gates closed" signal. Processor 316 monitors the safety and self-diagnostics of the system for changes to the systems operability. Processor 316 updates the time and synchronization data received from GPS system 322. The external indication to enter analysis state 412, in one embodiment, is the receipt from an external source that the gates of the railroad grade crossing have been lowered. Additionally, during stand-by state 410, processor 316 receives information from Global Positioning Satellite (GPS) receiver system 322. This information may include any of the available GPS satellite provided information. In one embodiment, this information includes time and/or synchronization information. Once the system receives an activation signal such as the gates closing signal, processor 316 shifts from stand-by state 410 to analysis state 412.

In analysis state 412, processor 316 sets a timer and initiates a transmission of transmitted signal 332 from transmitter 302. In one embodiment, the timer is set for 5 seconds. The system receives signals from receiver 302 that are analyzed to determine the characteristic 340 as introduced by modulating reflector 308 as described above. If the modulated signal 330 containing the desired amount of characteristic 340 is received by receiver 302 and continues to be received by receiver 302 as described above until the timer terminates, processor 316 determines that surveillance area 334 is clear of obstacles. When this occurs, processor 316 shifts to an area clear state 414. Area clear state 414 initiates the consent action 326 and, after receiving a signal indicating the gates have been opened (not shown), processor 316 is returned to stand-by state 410. In one embodiment, consent action 326 is the setting of an "all clear" relay but may be other actions including the sending of a message to a remote site or system via a communication link (not shown).

Processor 316 analyzes the received signal 338 from receiver 302 and determines the presence of an obstruction in surveillance area 334. In one embodiment, an obstruction is determined (as described above) during the period of the timer, the system shifts to an area occupied state 416. In area occupied state 416, received signal 338 continues to be monitored to determine whether the obstacle continues to be located in surveillance area 334 or whether the obstacle has moved out of surveillance area 334 and the area is no longer obstructed. If this is determined and the timer has expired, the system shifts to area clear state 414. If the obstacle is determined by processor 316 to be moving within surveillance area 334 (as will be discussed below), the system continues to monitor for the presence of the obstacle. To determine this, filter algorithms are used in conjunction with repeated scanning of surveillance area 334. If after a defined period of time, which in one embodiment may be the period of the timer, then area occupied state 416 initiates alarm action 328. In one embodiment, alarm action 328 may be the activation of an alarm relay (not shown). In another embodiment, alarm action 328 may be other actions including the sending of an alarm message to a remote site or system via the communication link (not shown).

If during analysis state 410, area occupied state 416, or area clear state 414, processor 316 receives a signal that the gates are no longer closed, processor 316 de-energizes any consent or alarm actions and returns the system to stand-by state 410.

If during stand-by state 410, analysis state 412, area clear state 414, or area occupied state 416, an error is detected or occurs in the system or in the operation of the system, the system shifts to a vital error state 418. Whenever the self-diagnostics of the system identifies a failure of transmitter 302A or receiver 302B, system components, or control logic or software operated by processor 316, the system also shifts to the vital error state 418. In vital error state 418, the diagnostic error is logged into a memory (not shown) and a system restart (not shown) may be initiated. In another embodiment, the system shifts to initialization state 404 for further analysis or system restart (not shown).

Figure 5A:
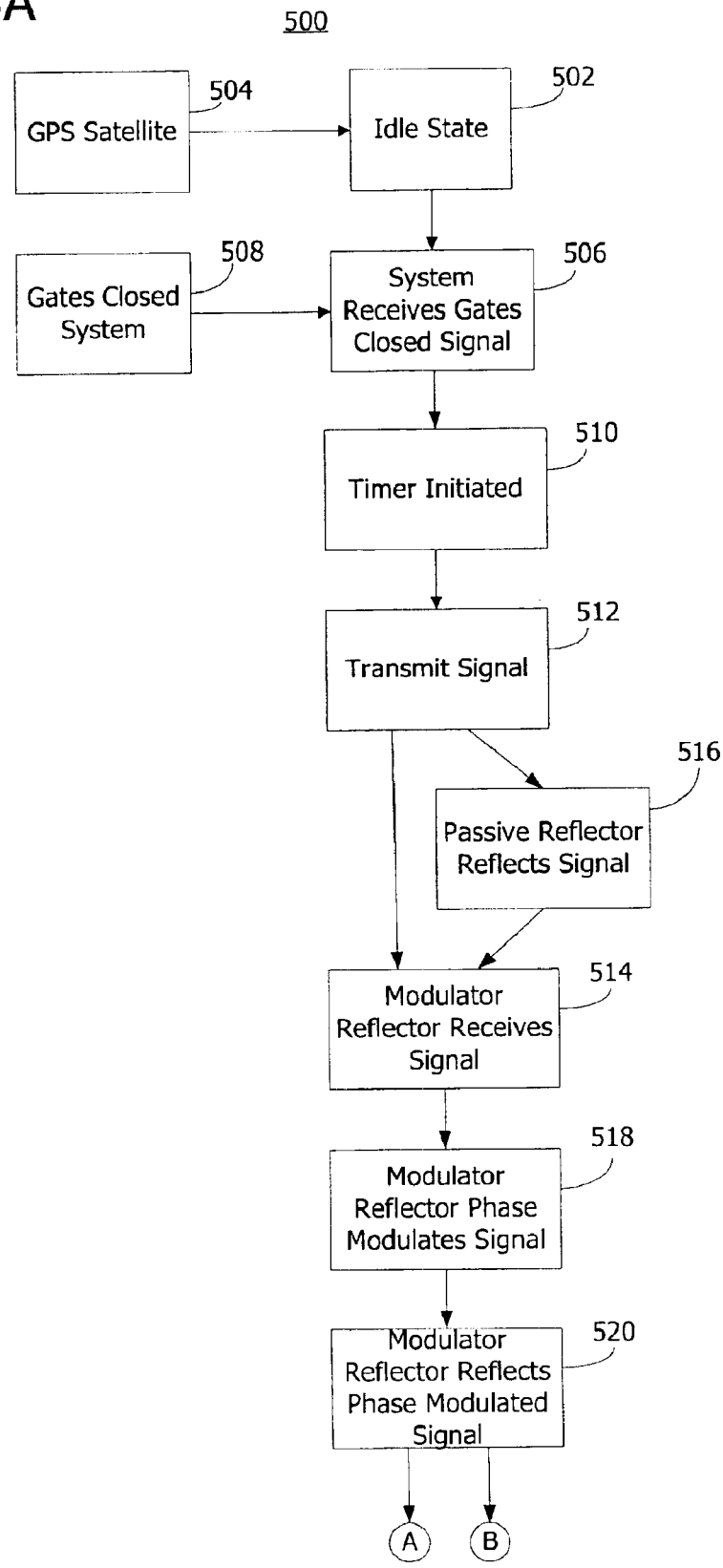
FIG. 5 is a logic flow diagram for an exemplary railroad grade crossing detector system and method.
Figure 5B:
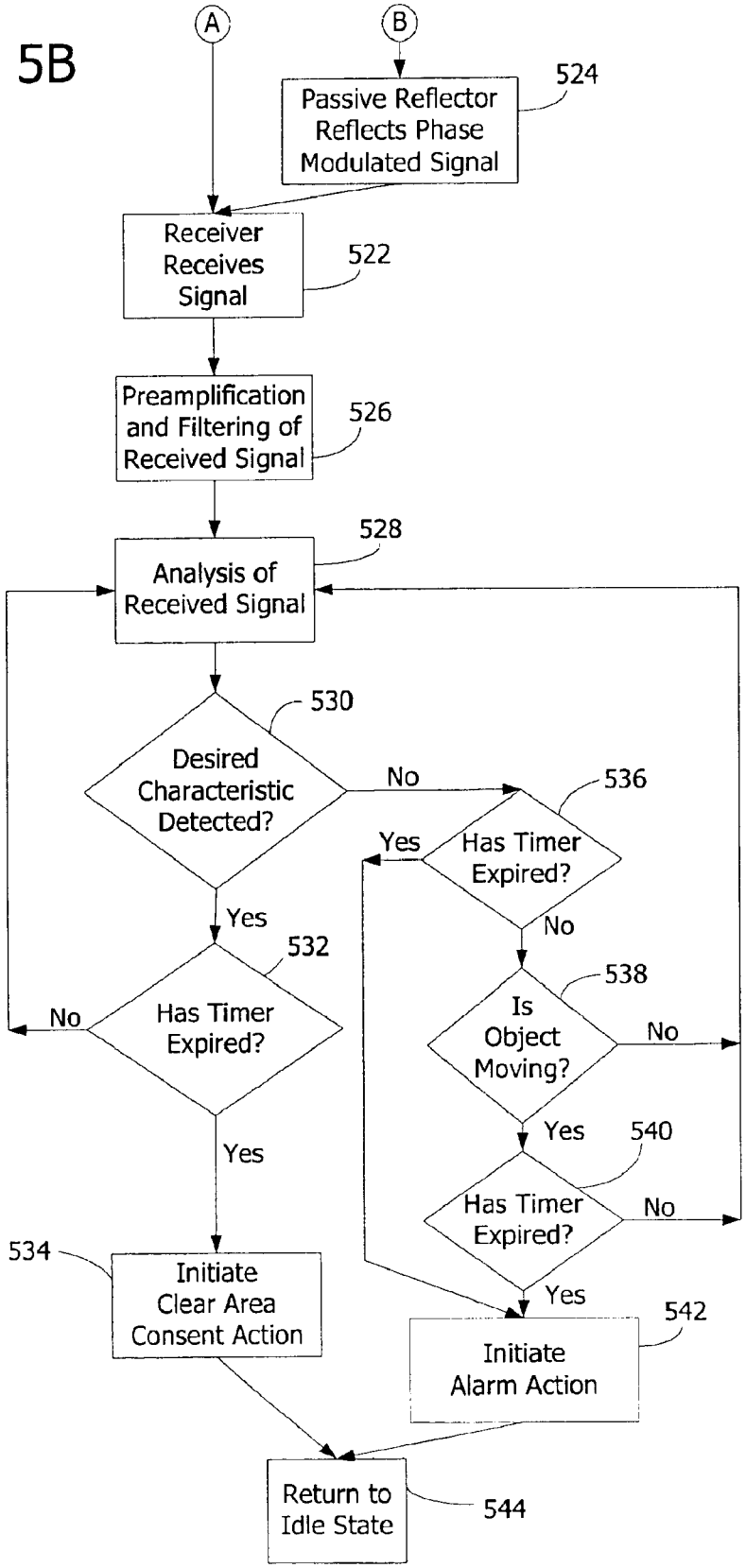

One embodiment of a method 500 for automatically detecting the presence of an obstacle located within surveillance area 334 associated with a railroad grade crossing is described in FIGS. 5A and 5B, collectively referred to as FIG. 5. The system being in an idle state 502, receives information from GPS system 322 on a scheduled, periodic, or continuous basis. The system awaits an actuating event or a command. In one embodiment, the system is activated automatically when the gates are closed such as upon receipt of a gates closed signal as at block 506. When gates closed signal 506 is received or an indication is received from a gates closed system 508, processor 316 initiates or sets a timer 510. Additionally, processor 316 initiates the transmission at block 512 of transmitted signal 332 by transmitter 302. In one embodiment, transmitted signal 332 is received directly by modulating reflector 308 at block 514. In another embodiment, transmitted signal 332 is received by passive reflector 310 and reflected from passive reflector 310 to modulating reflector 308. In either case, modulating reflector 308 receives transmitted signal 332 at block 514. Modulating reflector 308 phase modulates received signal 338 at block 518 and reflects or transmits the modulated signal 330 at block 520.

Modulated signal 330 is reflected back towards receiver 302B or is transmitted as modulated signal 330A to passive reflector 310 which then reflects modulated signal 330B containing characteristic 340 to receiver 302B. In either case, receiver 302B may receive signal 338 at block 522 which may or may not contain the desired amount of characteristic 340 as introduced by modulating reflector 308. Received signal 338 is processed at block 528 to determine the presence of the desired amount of characteristic 340 within received signal 338 as described above. In one optional embodiment, received signal 338 is first processed by preamplifier and filter 312 at block 526 to obtain a processed signal such as a base band signal.

If desired amount of characteristic 340 is detected at block 530 (as discussed above), processor 316 checks to see if the timer has expired at block 532. If the timer has not expired, processor 316 continues to analyze received signal 338 at block 528. If desired amount of characteristic 340 continues to be detected at block 530 and the timer has expired at block 532, processor 316 initiates a clear area consent action at block 534. Once the consent action is initiated, the system returns to the idle state at block 544.

If during the analysis at block 528, processor 316 determines that desired amount of characteristic 340 is not present at 530, processor 316 checks the timer to ensure that it has not expired. If the timer has expired at block 536, processor 316 initiates alarm action 328 at block 542. Once alarm action 328 is initiated at block 542, the system returns to the idle state at block 544.

However, if during the analysis at block 528 processor 316 determines that received signal 338 does not include desired amount of characteristic 340 at block 530 and the timer has not expired, processor 316 determines whether the detected object or obstruction is moving within surveillance area 334 or whether it is stationary at block 538. Processor 316 determines whether the detected object is moving or is stationary within surveillance area 334 by comparing one received signal 338B with another received signal 338A and determining and analyzing the changes or differences between the two signals. A first received signal 338A may be compared to a second received signal 338B. Changes between first received signal 338A and second received signal 3381B may be compared to a threshold, model, or signature to determine whether the object is the same object as detected in the second received signal 338B as the first received signal 338A, and if so, changes may be indicative of movement of the object with surveillance area 334. For example, where changes in amplitude of the first sideband is lower than the threshold amplitude for a period of time shorter than 2 seconds, processor 316 may determine that the object is moving in surveillance area 334.

In the alternative, a change in the amplitude peak of the first sideband of received signal 338 by 20 percent may be indicative of a moving object. Processor 316 makes this determination by evaluating received signal 338 over time to identify variations in the amplitude, frequency, or energy of the sidebands in received signal 338. Additionally, two or more received signals 338 may be analyzed in the embodiment where two or more transceivers 302 are utilized to define a single surveillance area 334 as described above. In such an embodiment, movement may be indicated by analyzing changes in two or more characteristics 340 from the two or more modulated signals 330.

If processor 316 determines that the obstruction or object is moving or in motion within surveillance area 334, processor 316 checks the timer at block 540. If the timer has expired at block 540, processor 316 initiates an alarm action at block 542. However if the timer has not yet expired at block 540, the system continues to analyze received signal 338 at block 528. If it is determined at block 538 that the object is not moving in surveillance area 334, the system continues to analyze received signal 338 to determine the modulation characteristic at block 528. This process continues until the timer expires.

Figure 6:
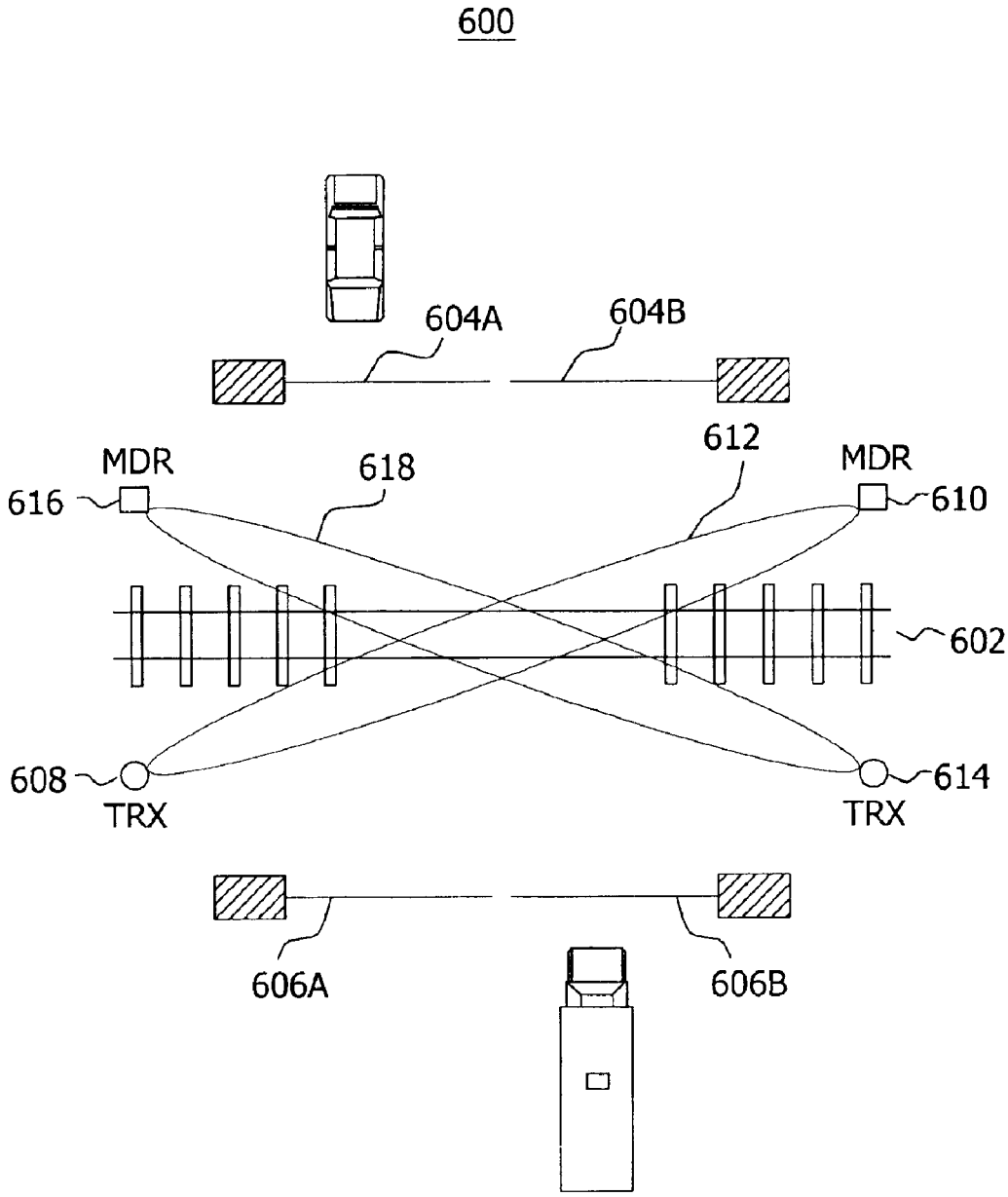
FIG. 6 is an illustration of an exemplary railroad grade crossing detector system for a single track crossing indicating one embodiment of the layout of transceivers, modulating reflectors, and the associated surveillance area.

FIG. 6 illustrates an exemplary railroad grade crossing detector system for a single track crossing indicating one embodiment of the layout of the transceivers 302, modulating reflectors 308, and resulting surveillance areas 334. A single track 602 is enclosed by crossing gates 604A and 604B and gates 606A and 606B. A first transceiver 608 transmits a first transmitted signal 332A (not shown) to first modulating reflector 610 and modulating reflector 610 reflects a first modulated signal 330A (not shown) to first transceiver 608 thereby defining a first surveillance area 612. A second transceiver 614 transmits a second transmitted signal 332B (not shown) to a second modulating reflector 616, wherein second modulating reflector 616 reflects a second modulating signal 330B to second transceiver 614 thereby defining a second surveillance area 618. In this single track railroad grade crossing, the system-defined surveillance areas 334 are surveillance areas 612 and 618.

Figure 7:
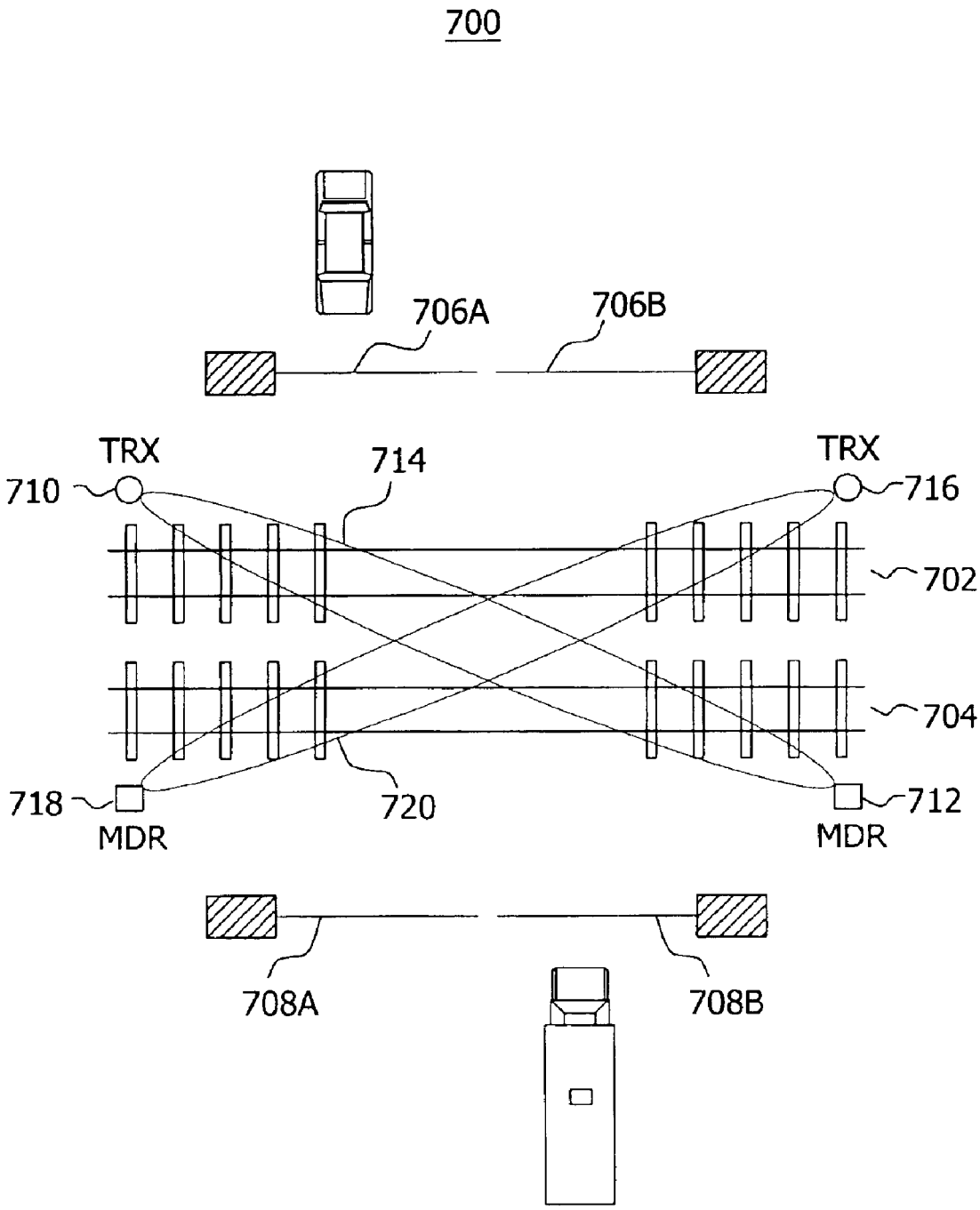
FIG. 7 is an illustration of an exemplary railroad grade crossing detector system for a two-track crossing indicating one embodiment of the layout of transceivers, modulating reflectors, and the associated surveillance area.

FIG. 7 illustrates an exemplary railroad grade crossing detector system for a two-track crossing indicating one embodiment of the layout of the transceivers 302, modulating reflectors 308, and associated surveillance areas 334. Tracks 702 and 704 are protected by gates 706A and 706B and gates 708A and 708B. A first transceiver 710 transmits a first microwave beam 714 to a modulating reflector 712. A first surveillance area 334 is defined by beam 714. A second transceiver 716 transmits a second microwave beam 720 to a modulating reflector 718. A second surveillance area 334 is defined by beam 720. In this two-track railroad grade crossing, the system-defined surveillance area 334 is the area defined by 714 and 720.

Figure 8:
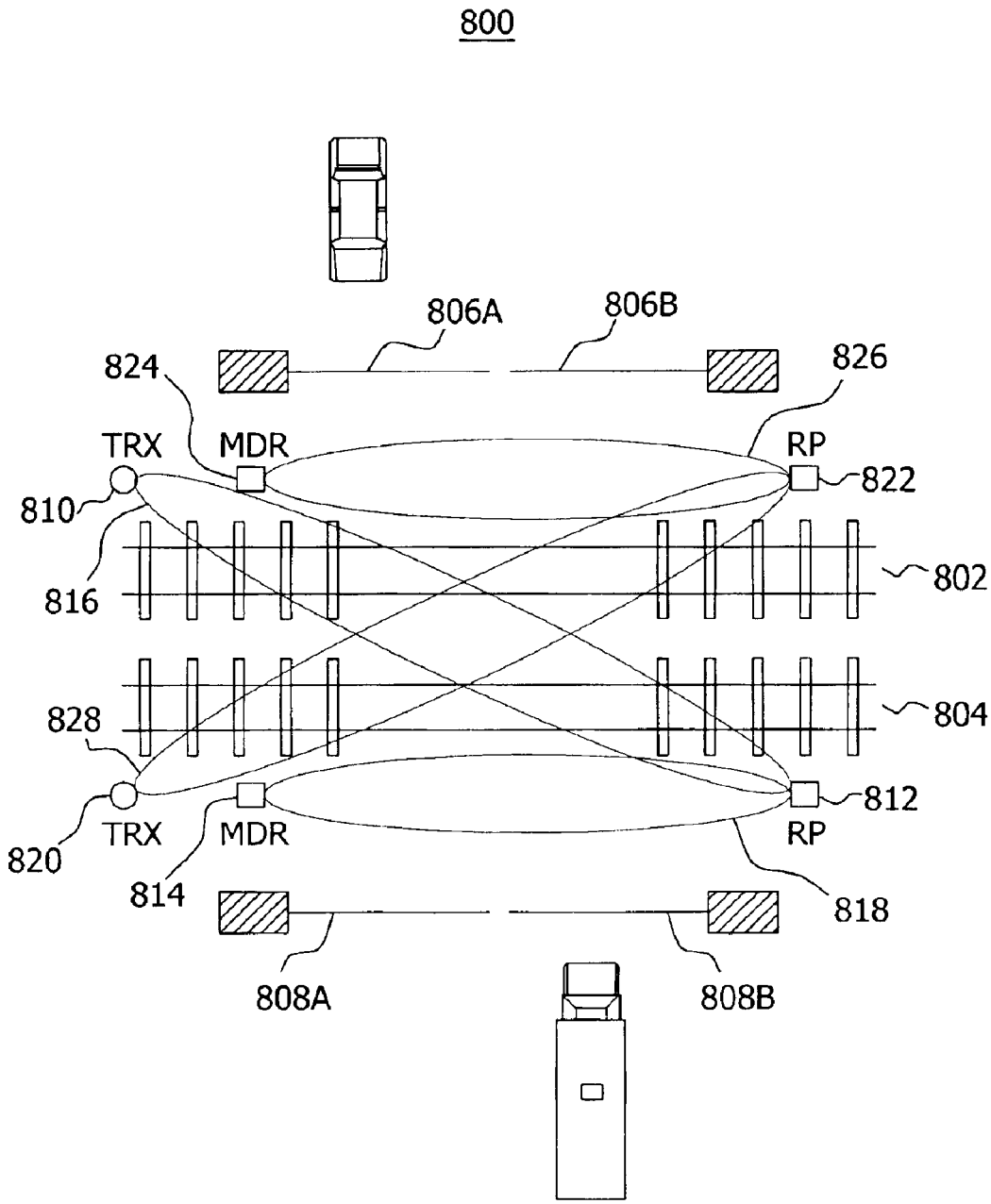
FIG. 8 is an illustration of an exemplary railroad grade crossing detector system for a two-track crossing indicating one embodiment of the layout of transceivers, modulating reflectors, passive reflectors, and the associated surveillance area.

FIG. 8 illustrates an exemplary railroad grade crossing detector system for a two-track crossing indicating one embodiment of the layout of the transceivers 302, modulating reflectors 308, passive reflectors 310, and surveillance area 334. Tracks 802 and 804 are protected by gates 806A and 806B and gates 808A and 808B. A first transceiver 810 transmits a first microwave beam 816 that is received by a passive reflector 812. Passive reflector 812 reflects the received beam 816 to modulating reflector 814 thereby creating a second beam 818. The resulting surveillance area 334 of the first transceiver is the area defined by beams 816 and 818. A second transceiver 820 transmits a third microwave beam 828 to a passive reflector 822. A passive reflector 822 reflects the received beam 828 to a modulating reflector 824 thereby creating a fourth beam 826. The resulting surveillance area 334 of the second transceiver is the area defined by beam 828 and 826.

Figure 9:
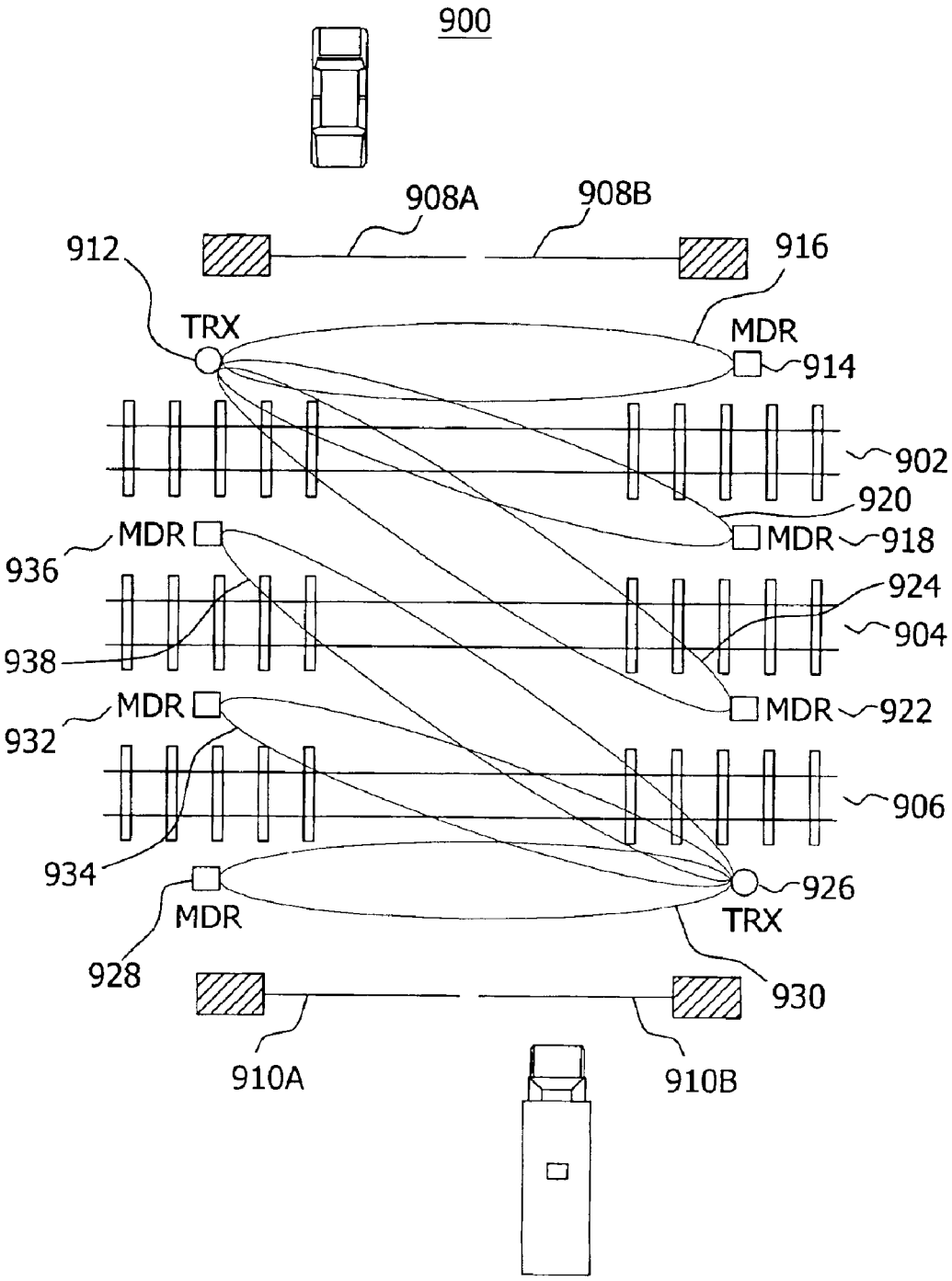
FIG. 9 is an illustration of an exemplary railroad grade crossing detector system for a three track crossing indicating one embodiment of the layout of transceivers, multiple modulating reflectors, and the associated surveillance area.

FIG. 9 illustrates an exemplary railroad grade crossing detector system for a three track crossing indicating one embodiment of the layout of the transceivers 302, multiple modulating reflectors 308, and surveillance area 334. Tracks 902, 904 and 906 are protected by gates 908A and 908B and gates 910A and 910B. A first transceiver 912 transmits three microwave beams. A first beam 916 of transceiver 912 is transmitted to a first modulating reflector 914. A second beam 920 of the first transceiver 912 is transmitted to a second modulating reflector 918. A third beam 924 of the first transceiver 912 is transmitted to a third modulating reflector 922. As such, surveillance area 334 of the first transceiver 912 is the area defined by beams 916, 920 and 924. In a similar manner, a second transceiver 926 transmits three microwave beams. A first beam 930 of transceiver 926 is transmitted to a first modulating reflector 928. A second beam 934 of the second transceiver 926 is transmitted to a second modulating reflector 932. A third beam 938 of the second transceiver 926 is transmitted to a third modulating reflector 936. As such, the surveillance area 334 of the second transceiver 926 is the area defined by beams 930, 934 and 938.

In the embodiment as shown in FIG. 9, transceivers 912 and 926 each transmit more than one transmitted signal 332, each such transmitted signal 332 being directed to a separate modulating reflector 308. Each modulating reflector 308 is configured to uniquely phase modulate transmitted signal 332 by introducing unique characteristics 340 to generate the associated unique modulated signal 330 based on the received transmitted signal 332 as received by each modulating reflector 308. Receiver 302B receives signals from one or more modulating reflectors 308. Receiver 302B, preamplifier 312, demodulator 314, and processor 316 are configured to identify each of the unique phase modulated signals 330 and characteristics 340 as described above to determine the unique characteristics 340 in each received modulated signal 330 and therefore the presence or absence of an object. Each of these are determined separately in order to separately determine whether or not the desired amount of each and every characteristic 340 has been received, thereby determining the presence or absence of an obstacle for each and every surveillance area 916, 920, 924, 930, 934 and 938. In this embodiment, the system and method operate to detect the amount of each and every characteristic 340 in each modulated signal 330 for the particular configuration and embodiment. In such an embodiment, the method and processes defined in FIG. 5 are performed for each and every separate phase modulated signal.

Those skilled in the art will note that the order of execution or performance of the methods illustrated and described herein is not essential, unless otherwise specified.

That is, it is contemplated that aspects or steps of the methods may be performed in any order, unless otherwise specified, and that the methods may include more or less or alternative aspects or steps than those disclosed herein.

As various changes could be made in the above exemplary constructions and methods without departing from the scope of the invention, it is intended that all matter contained in the above description or shown in the accompanying drawings shall be interpreted as illustrative and not in a limiting sense.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

What is claimed is:

1. A system for automatically detecting the presence of an obstacle located within a surveillance area associated with a railroad grade crossing, said system comprising;

a transmitter transmitting a signal through the surveillance area;

a modulating reflector receiving the transmitted signal, said reflector comprising a phase modulator receiving the received signal and generating a phase modulated signal having a characteristic introduced by the modulating reflector, said modulating reflector transmitting the phase modulated signal through the surveillance area;

a receiver located to receive the phase modulated signal; and a processor coupled to the transmitter and to the receiver, said processor configured to process the received phase modulated signal and configured to initiate an action as a function of the characteristic in the received phase modulated signal.

2. The system of claim 1 wherein the processor compares an amount of the characteristic in the received signal to a predetermined threshold or characteristic.

3. The system of claim 1 wherein the characteristic is selected from the following list: an amplitude of a first sideband of the received phase modulated signal; an amplitude of a second sideband of the received phase modulated signal; an energy in a first sideband of the received phase modulated signal; an energy in first, second, and third sidebands of the received phase modulated signal; a frequency of an amplitude peak of a first sideband of the received phase modulated signal; and a frequency of an amplitude peak of a second sideband of the received phase modulated signal.

4. The system of claim 1 wherein the transmitter comprises a frequency modulated carrier transmitter and the receiver comprises a frequency modulated carrier receiver, the frequency modulated transmitter and the frequency modulated receiver each being responsive and sensitive to a peak of the processed signal.

5. The system of claim 1 wherein the receiver comprises two quadrature receivers or two orthogonal receivers.

6. The system of claim 1, further comprising a passive reflector, wherein the passive reflector is located between the transmitter and the modulating reflector and wherein the passive reflector reflects the transmitted signal received from the transmitter to the modulating reflector.

7. The system of claim 1, further comprising a passive reflector, wherein the passive reflector is located between the modulating reflector and the receiver, and wherein the passive reflector reflects the phase modulated signal from the modulating reflector to the receiver.

8. The system of claim 1 wherein the transmitter transmits a continuous wave microwave signal between 9.2 GHz and 10.6 GHz.

9. The system of claim 1 wherein the phase modulator phase modulates the received signal by creating a phase variation of between 0 degrees and 180 degrees at a frequency from the following frequencies: 4.0 KHz, 4.7 KHz, 5.7 KHz, 6.7 KHz, 9.0 KHz, and 12.0 KHz.

10. The system of claim 1 wherein the processor is configured to initiate an alarm action when the processor fails to detect the characteristic within the received phase modulated signal.

11. The system of claim 1 wherein the processor is configured to initiate a consent action when the processor detects the characteristic within the received phase modulated signal.

12. The system of claim 1, further comprising a timer, wherein the transmitter is responsive to the processor, said processor is configured to receive a gates closed signal and is configured to initiate the transmitter to transmit the transmitted signal upon receipt of a gates closed signal, and said transmitter is configured to continue to transmit the transmitted signal, wherein the processor continues to process the received signal until said timer expires.

13. The system of claim 1, further comprising a preamplifier and a filter coupled between the receiver and the processor, said preamplifier and filter conditioning the received signal prior to said processor processing the received phase modulated signal.

14. The system of claim 1, further comprising a Global Positioning Satellite (GPS) receiver, said GPS receiver providing a time and a position signal to the processor.

15. The system of claim 1, further comprising a memory, wherein the processor stores in said memory the action initiated by the processor.

16. A method for automatically detecting the presence of an obstacle located within a surveillance area associated with a railroad grade crossing comprising:

transmitting a microwave signal through the surveillance area;

receiving the microwave signal at a modulating reflector;

phase modulating the received microwave signal by a phase modulator creating a phase modulated signal containing a characteristic;

transmitting the phase modulated signal through the surveillance area;

receiving the phase modulated signal at a receiver;

processing the phase modulated signal to determine the characteristic within the received phase modulated signal; and initiating an action as a function of the determined characteristic of the received phase modulated signal.

17. The method of claim 16 wherein processing the phase modulated signal determines the characteristic in the received phase modulated signal by comparing an amount of determined characteristic in the received phase modulated signal to a predetermined threshold or characteristic.

18. The method of claim 16 wherein phase modulating the signal creates the characteristic from the following list: an amplitude of a first sideband of the received phase modulated signal; an amplitude of a second sideband of the received phase modulated signal; an energy in a first sideband of the received phase modulated signal; an energy in first, second, and third sidebands of the received phase modulated signal; a frequency of an amplitude peak of a first sideband of the received phase modulated signal; and a frequency of an amplitude peak of a second sideband of the received phase modulated signal.

19. The method of claim 16, further comprising receiving the transmitted microwave signal and passively reflecting the microwave signal, wherein the receiving of the microwave signal at the modulating reflector is receiving the microwave signal as passively reflected.

20. The method of claim 16, further comprising:

receiving the reflected phase modulated signal; and passively reflecting the phase modulated signal, wherein the receiving of the signal at the receiver is receiving the phase modulated signal as passively reflected.

21. The method of claim 16 wherein transmitting a microwave signal comprises transmitting a continuous wave microwave signal between 9.2 GHz and 10.6 GHz.

22. The method of claim 16 wherein phase modulating the received microwave signal at the modulating reflector is modulating the received signal by creating a phase variation of between 0 degrees and 180 degrees at a frequency of one of the following frequencies: 4.0 KHz, 4.7 KHz, 5.7 KHz, 6.7 KHz, 9.0 KHz, and 12.0 KHz.

23. The method of claim 16 wherein initiating an action is initiating an alarm action.

24. The method of claim 16 wherein initiating an action is initiating a consent signal.

25. The method of claim 16, further comprising:

receiving a gates closed signal;

initiating the transmitter to transmit the transmitted signal upon receipt of a gates closed signal; and terminating the transmitter to transmit the transmitted signal upon the expiration of a timer.

26. The method of claim 16, further comprising pre-amplifying and filtering the received phase modulated signal, wherein processing the phase modulated signal is processing the received phase modulated signal as pre-amplified and filtered.

27. The method of claim 16, further comprising receiving data from a Global Positioning Satellite (GPS) receiver that includes the time.

28. The method of claim 16, further comprising storing in a memory the initiated action.

* * * * *